US005596967A

United States Patent [19]

Burborough

[11] Patent Number: 5,596,967

[45] Date of Patent: Jan. 28, 1997

[54] FUEL PUMP

[75] Inventor: William R. Burborough, Gillingham, England

[73] Assignee: Lucas Industries public limited company, England

[21] Appl. No.: 574,121

[22] Filed: Dec. 18, 1995

[30] Foreign Application Priority Data

Jan. 7, 1995 [GB] United Kingdom ..... 9500294

[51] Int. Cl.[6] ..... F02M 41/00

[52] U.S. Cl. ..... 123/450

[58] Field of Search ..... 123/450, 451, 123/198 F

[56] References Cited

U.S. PATENT DOCUMENTS 3,057,299 10/1962 Roosa .

4,458,652 7/1984 Shiozawa et al. ..... 123/449

5,245,971 9/1993 Rembold et al. ..... 123/450

FOREIGN PATENT DOCUMENTS 2115078 1/1983 United Kingdom .

*Primary Examiner*—Thomas N. Moulis

*Attorney, Agent, or Firm*—Andrus, Sceales, Starke & Sawall

[57] ABSTRACT

A rotary distributor pump for supplying fuel to a six cylinder engine is adapted to supply fuel to a three cylinder engine by connecting its three inactive outlet ports to chambers and by arranging that no fuel is supplied to its pumping chamber prior to registration of its delivery passage with an inactive outlet port. In order to minimise the risk of cavitation of the fuel within the chambers they are vented to a low pressure source of fuel just before the delivery passage registers with an inactive outlet port.

4 Claims, 1 Drawing Sheet

FUEL PUMP

This invention relates to a rotary distributor type fuel injection pumping apparatus for supplying fuel to a three cylinder compression ignition engine, the apparatus being of the kind comprising a rotary distributor member which is driven in use in timed relationship with the associated engine, the distributor member being housed within a sleeve in which there is formed six equi-angularly spaced outlet ports, the distributor member being provided with a delivery passage which registers with said outlet ports in turn as the distributor member rotates, the delivery passage communicating with a pumping chamber defined between a pair of pumping plungers located in a diametrically disposed bore formed in the distributor member, a cam ring surrounding the distributor member, six equi-angularly spaced cam lobes formed on the internal periphery of the cam ring, said cam lobes imparting inward movement to the pumping plungers as the distributor member rotates and during the time when the delivery passage is in register with an outlet port, alternate ones of said outlet ports hereinafter termed the inactive outer ports, being connected to a fuel reservoir defined in the body of the apparatus and the remaining outlet ports hereinafter being termed the active outlet ports, being connected to outlets respectively which in use are connected to the injection nozzles respectively of the associated engine and fuel supply means operable to supply fuel to the pumping chamber to effect outward movement of the pumping plungers in those periods between actuation of the pumping plungers by the cam lobes, prior to registration of the delivery passage with an active outlet port.

It will be appreciated that the apparatus as outlined above is a modified form of an apparatus for supplying fuel to a six cylinder engine, the modification being that fuel supply to the pumping chamber only takes place three times per revolution of the distributor member immediately prior to delivery of fuel to the engine.

It is conventional practice to shape the trailing flanks of the cam lobes to provide for limited outward movement of the plungers following delivery of fuel followed by a short period during which the plungers are held against movement whilst the delivery passage moves out of register with the active outlet port. This allows for a controlled reduction of the pressure in the active outlet port and in the associated outlet and the pipeline connecting the outlet with the nozzle. As a result of the limited outward movement even though no fuel is supplied to the pumping chamber, the pumping plungers will be moved inwardly when the leading flanks of the next pair of cam lobes are encountered. As a result a small volume of fuel will be displaced through the inactive outlet port to the reservoir and the fuel pressure therein will increase.

As the distributor member continues to rotate and since the cam lobes all must have the same profile, limited outward movement of the plungers take place and during the following short period the delivery passage moves out of register with the inactive outlet port. Some relaxation of the pressure within the reservoir does take place but it is found that the fuel remaining in the reservoir is at a substantial pressure. The reason for this is that the residual line pressure following the limited outward movement of the plungers is carried over via the rotor to the non-injecting cycle where it causes the pressure in the inactive outlet port and the reservoir to rise.

The next time the delivery passage moves into register with an inactive outlet port fuel under pressure in the reservoir is released into the delivery passage and the sudden outflow of fuel can cause cavitation to take place in the fuel in the reservoir and the inactive outlet port. The cavities are collapsed as the pumping plungers are moved inwardly and this can lead to cavitation erosion.

The object of the present invention is to provide an apparatus of the kind specified in an improved form.

According to the invention in an apparatus of the kind specified means is provided to connect said reservoir to a low pressure source of fuel prior to registration of the delivery passage with an inactive outlet port.

An example of a fuel pumping apparatus in accordance with the invention will now be described with reference to the accompanying drawings in which.

Figure 1:
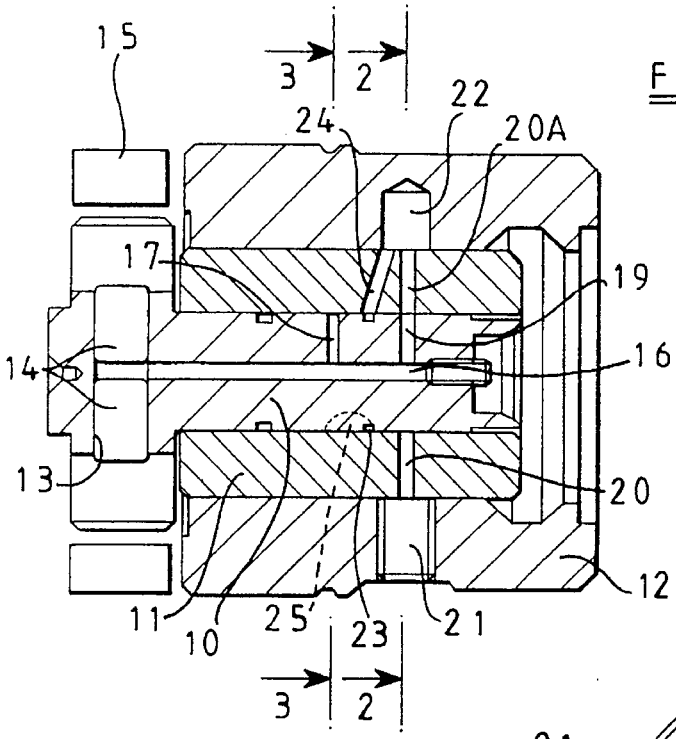
FIG. 1 is a sectional side elevation of one form of the apparatus.

Referring to the drawings the apparatus is a modified form of an apparatus for supplying fuel to a six cylinder engine and comprises a rotary distributor member 10 which is housed within a sleeve 11 which is a tight fit within a body 12 of the apparatus.

The distributor member projects from the sleeve and is coupled to a drive shaft (not shown) which is driven by the associated engine so that the distributor member rotates in synchronism therewith. The projecting portion of the distributor member is provided with a transverse bore 13 in which is mounted a pair of pumping plungers 14. At their outer ends the plungers are engaged by cam followers (not shown) each cam follower including a roller which engages with the internal peripheral surface of a cam ring 15. The cam ring is provided with six equiangularly spaced cam lobes the leading flanks of which as the distributor member is rotated, can impart inward movement to the plungers by way of the cam followers. The trailing flanks of the cam lobes are shaped as well known in the art, to provide limited outward movement of the plungers followed by a dwell period before full outward movement of the plungers can take place.

The bore 13 intermediate the pumping plungers 14 defines a pumping chamber which is in communication with an axially extending passage 16 formed in the distributor member. At one point the axially extending passage as shown in FIG. 3, communicates with a radially disposed inlet passage 17 and this is positioned to register in turn with three equiangularly spaced inlet ports 18 formed in the sleeve 11 and communicating with a source of fuel under pressure conveniently a low pressure pump 18A the rotor of which is driven by the distributor member 10.

Figure 2:
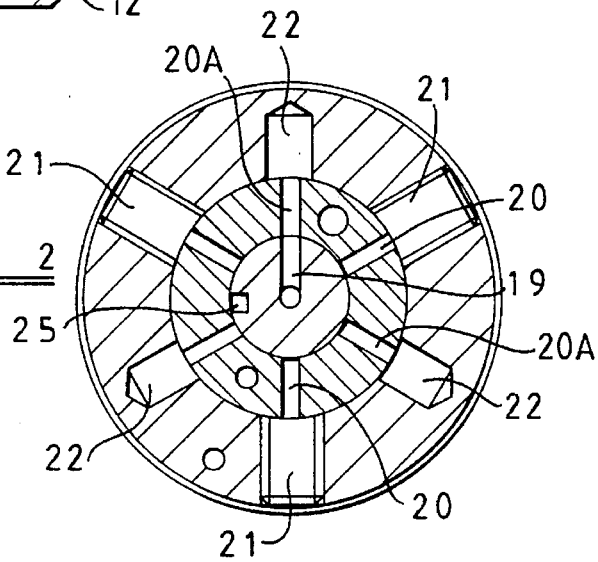
FIG. 2 is an end section on the line 2—2 of FIG. 1.

The axial passage 16 also communicates with a radially disposed delivery passage 19 and this is positioned to register in turn with six outlet ports which are formed in the sleeve these being clearly shown in FIGS. 1 and 2. Alternate ones of the outlet ports hereinafter termed the active outlet ports 20, are connected to outlets 21 respectively which are formed in the body 12 and in use, the outlets 21 are connected to the injection nozzles of the associated engine. The other outlet ports hereinafter called the inactive outlet ports 20A are connected to a reservoir formed by respective chambers 22 which are formed in the body 12. The chambers are connected to a circumferential groove 23 formed in the periphery of the distributor member by respective connecting passages 24 formed in the sleeve.

Figure 3:
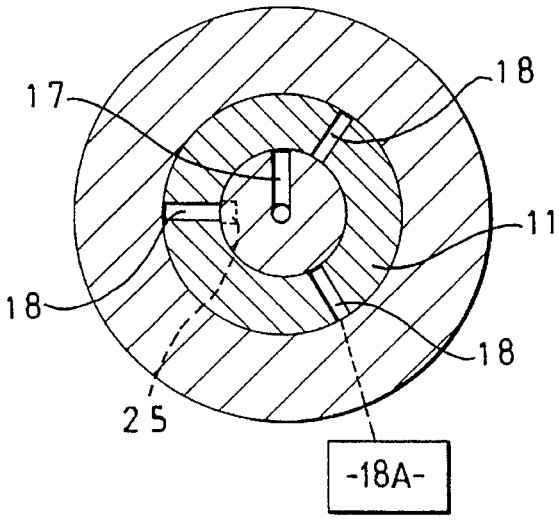
FIG. 3 is a view similar to FIG. 2 taken on the line 3—3 of FIG. 1.

Considering now the operation of the apparatus so far described and assuming that the distributor member 10 rotates in the clockwise direction when considering FIGS. 2 and 3. As shown in the drawings, the delivery passage 19 is in register with an inactive outlet port 20A and during this period of registration the pumping plungers will be moved inwardly a small amount by the leading flanks of a pair of the cam lobes on the internal peripheral surface of the cam ring 15. The inward movement of the plungers will displace fuel into each one of the chambers 22 by virtue of their interconnection by way of the respective passages 24 and the circumferential groove 23. As the distributor member rotates, limited outward movement of the plungers takes place before the delivery passage moves out of register with the inactive outlet port and during further rotation the inlet passage 17 will move into register with an inlet port 18 to permit fuel to flow into the pumping chamber from the pump 18A thereby causing further outward movement of the pumping plungers. The extent of fuel flow into the pumping chamber can be controlled by means of a throttle (not shown) so that the extent of outward movement will depend upon the setting of the throttle. During further rotational movement of the distributor member the inlet passage 17 moves out of register with an inlet port 18 and the delivery passage 19 moves into register with an active outlet port 20. As soon as this registration is established the plungers can be moved inwardly by the next pair of cam lobes and fuel will be supplied to the associated engine. As stated the trailing flanks of the cam lobes are shaped to allow limited outward movement of the plungers and whilst the delivery passage is in register with an active outlet port a controlled reduction of pressure in the pipeline connected to that port takes place. During the next period of rotation of the distributor member no fuel is supplied to the pumping chamber because there are only three inlet ports but when the delivery passage 19 has registered with the next inactive outlet port 20A there will be limited inward movement of the pumping plungers which charges the chambers 22 with fuel. Thereafter the cycle of operations is repeated and fuel is supplied to the engine cylinders in turn.

As previously mentioned when the delivery passage moves out of register with an inactive outlet port 20A, the chambers 22 will contain fuel under pressure so that when the delivery passage 19 next registers with an inactive outlet port 20A, the fuel under pressure in the chambers flows into the delivery passage with the possibility of cavities being created within the chambers and inactive outlet ports. It will be appreciated that when the delivery passage registers with an inactive outlet port 20A the plungers 14 are more or less at their innermost positions and are not under the control of the cam lobes so that the fuel can flow from the chambers 22 through the delivery passage towards the pumping chamber the pressure in which is extremely low or even negative due to the centrifugal forces acting upon the plungers. Any cavities which form in the chambers are closed as the pumping plungers are moved inwardly by the cam lobes, with the result that cavitation erosion can occur. The possibility of cavitation occurring increases with engine speed.

In order to minimise the possibility of cavities being formed it is proposed to place the chambers 22 and the associated inactive outlet ports 20A in communication with the source 18A of fuel under pressure so as to allow the fuel pressure in the chambers to reduce more gradually. This is effected by means of a longitudinal groove 25 which is formed in the periphery of the distributor member and which at one end is in communication with the circumferential groove 23. The groove 25 is positioned so that its other end can register with the inlet ports 18 in turn, such communication taking place immediately prior to the delivery passage 19 moving into register with an inactive outlet port 20A. The effect therefore is to lower the fuel pressure in all the chambers to the outlet pressure of the source of fuel under pressure and thereby the risk of cavitation of the fuel within the chambers is minimised.

I claim:

1. A rotary distributor type fuel injection pumping apparatus for supplying fuel to a three cylinder compression ignition engine, the apparatus being of the kind comprising a rotary distributor member which is driven in use in timed relationship with the associated engine, the distributor member being housed within a sleeve in which there is formed six equi-angularly spaced outlet ports, the distributor member being provided with a delivery passage which registers with said outlet ports in turn as the distributor member rotates, the delivery passage communicating with a pumping chamber defined between a pair of pumping plungers located in a diametrically disposed bore formed in the distributor member, a cam ring surrounding the distributor member and having six equi-angularly spaced cam lobes formed on its internal peripheral surface, said cam lobes imparting movement to the pumping plungers as the distributor member rotates and during the time when the delivery passage is in register with an outlet port, alternate ones of said outlet ports being connected to a fuel reservoir defined in a body of the apparatus and the remaining outlet ports being connected to outlets respectively which in use are connected to the injection nozzles respectively of the associated engine and fuel supply means operable to supply fuel to the pumping chamber to effect outward movement of the pumping plungers in those periods between actuation of the pumping plungers by the cam lobes, prior to registration of the delivery passage with an outlet port connected to an outlet and by means operable to connect said reservoir to a low pressure source of fuel prior to registration of the delivery passage with the inactive outlet ports.

2. An apparatus according to claim 1, in which said means comprises ports formed in said sleeve, the ports communicating with the source of fuel under pressure, and a groove formed in the periphery of the distributor member for registration with said ports in turn.

3. An apparatus according to claim 2, in which said reservoir is defined by three separate chambers, each chamber communicating with a respective inactive outlet port, each chamber also communicating with a circumferential channel formed on the distributor member, and said groove also communicating with said channel.

4. An apparatus according to claim 2, in which said ports also form part of said fuel supply means, a further part of said fuel supply means comprising an inlet passage formed in the distributor member, said inlet passage communicating with the pumping chamber and being positioned to register with said ports in turn prior to delivery of fuel through said active outlet ports.

* * * * *